US006427585B1

(12) United States Patent
Brown et al.

(10) Patent No.: US 6,427,585 B1
(45) **Date of Patent: *Aug. 6, 2002**

(54) METHOD AND APPARATUS FOR MEASURING THE LENGTH OF A WASTE LOG AND/OR WEIGHT OF WASTE LOG WHILE COMPACTING AND TRANSFERRING THE WASTE LOG FOR TRANSPORT

(75) Inventors: Ronald L. Brown, Vernon; Steven G. Seagraves, Caledonia, both of AL (US)

(73) Assignee: Marathon Equipment Company, Vernon, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/697,359

(22) Filed: Oct. 27, 2000

Related U.S. Application Data

(63) Continuation of application No. 09/255,795, filed on Feb. 23, 1999, now Pat. No. 6,138,557.

(51) Int. Cl.[7] ..... B30B 15/00; B30B 15/32

(52) U.S. Cl. ..... 100/41; 100/45; 100/99; 100/191; 100/100; 53/439; 53/502; 53/504; 53/509; 414/400; 414/809

(58) Field of Search ..... 100/35, 41, 43, 100/45, 99, 189, 191, 249, 250, 100; 53/438, 439, 502, 504, 529; 414/400, 809, 21

(56) References Cited

U.S. PATENT DOCUMENTS

| | | | | |
|---|---|---|---|---|
| 3,059,789 A | * | 10/1962 | Bowles | 100/100 |
| 3,301,414 A | * | 1/1967 | Clar | 100/100 |
| 3,575,103 A | * | 4/1971 | Charles | 100/100 |
| 3,871,289 A | | 3/1975 | Wilhite | 100/4 |
| 3,880,072 A | * | 4/1975 | Ord | 100/100 |
| 4,040,230 A | | 8/1977 | Pessel et al. | 53/24 |
| 4,099,457 A | | 7/1978 | Hyden | 100/42 |
| 4,123,970 A | | 11/1978 | Quante | 100/45 |
| 4,125,071 A | | 11/1978 | Young | 100/191 |
| 4,487,120 A | * | 12/1984 | Barstow | 100/100 |
| 4,522,120 A | | 6/1985 | Olfert | 100/4 |
| 4,729,301 A | | 3/1988 | Smith et al. | 100/43 |
| 4,729,304 A | | 3/1988 | Gardella et al. | 100/218 |
| 4,817,520 A | | 4/1989 | Brown et al. | 100/41 |
| 4,923,356 A | | 5/1990 | Foster | 414/373 |
| 5,123,338 A | | 6/1992 | Mathis | 100/43 |
| 5,363,758 A | | 11/1994 | Wildes et al. | 100/43 |
| 5,927,188 A | | 7/1999 | Gombos et al. | 100/45 |
| 6,138,557 A | | 10/2000 | Brown et al. | 100/41 |

FOREIGN PATENT DOCUMENTS

| | | |
|---|---|---|
| DE | 3722-741 | 7/1987 |
| EP | 408-964 | 1/1991 |

* cited by examiner

*Primary Examiner*—Stephen F. Gerrity
*Assistant Examiner*—Louis K. Huynh
(74) *Attorney, Agent, or Firm*—Liniak, Berenato, Longacre & White, LLC

(57) ABSTRACT

A compaction and transfer apparatus adapted to measure the length and/or weight of a waste log during compaction and transfer thereof, is provided. The apparatus comprises a compaction chamber, a closure device, a compaction ram, and a movement and/or weight detector. The compaction chamber is adapted to receive waste material. The compaction chamber has a discharge opening. The closure device is selectively movable into and out of the discharge opening to control the size of the discharge opening. The compaction ram is movable through the chamber to press the waste material against the closure device and thereby provide compaction of the waste material. The movement detector preferably is mounted on the closure device. The movement detector is adapted to detect movement of the waste material through the discharge opening, which movement corresponds to the length of the waste log extending out of the discharge opening. The weight detector is adapted to detect a total weight of the waste material in the compaction chamber and any portion of the waste log which extends out through the discharge opening. Preferably, the weight and/or length is used in controlling the compaction and transferring operation so that capabilities of a trailer are not exceed. Also provided are methods of measuring the length and/or weight of a waste log during a compaction and transfer operation.

16 Claims, 7 Drawing Sheets

Fig. 8
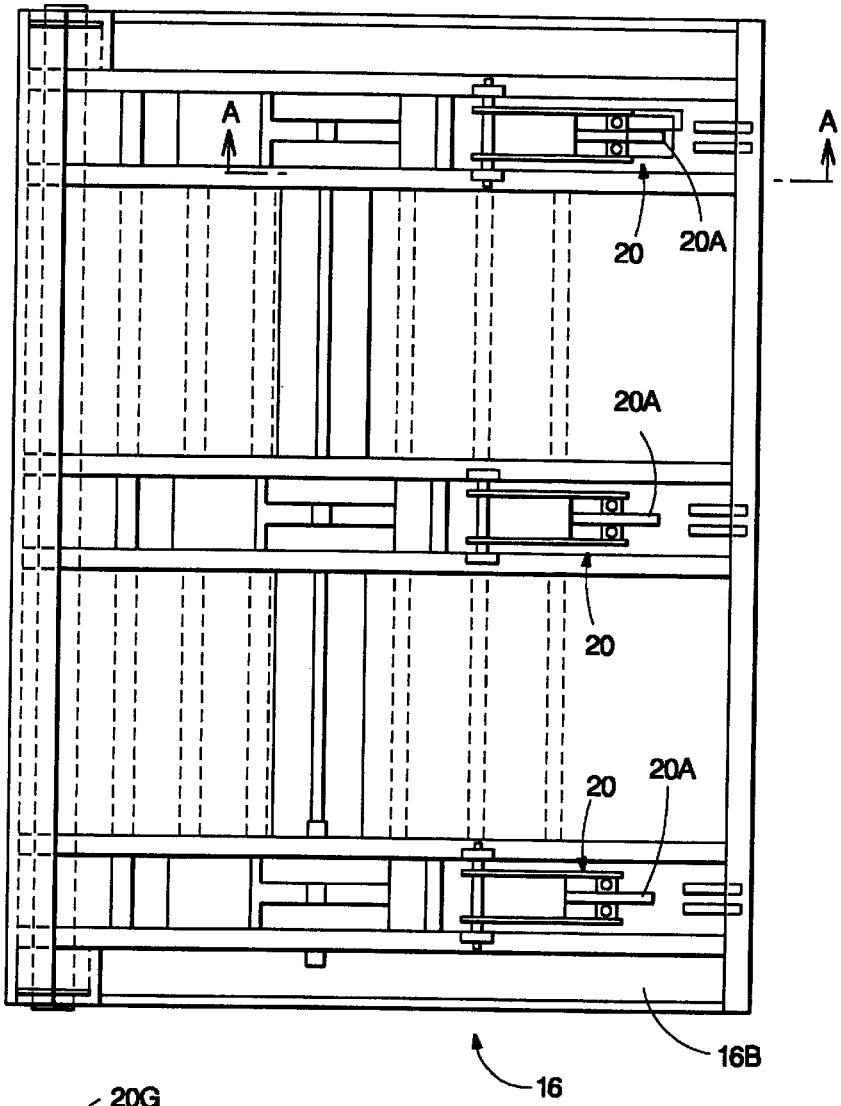
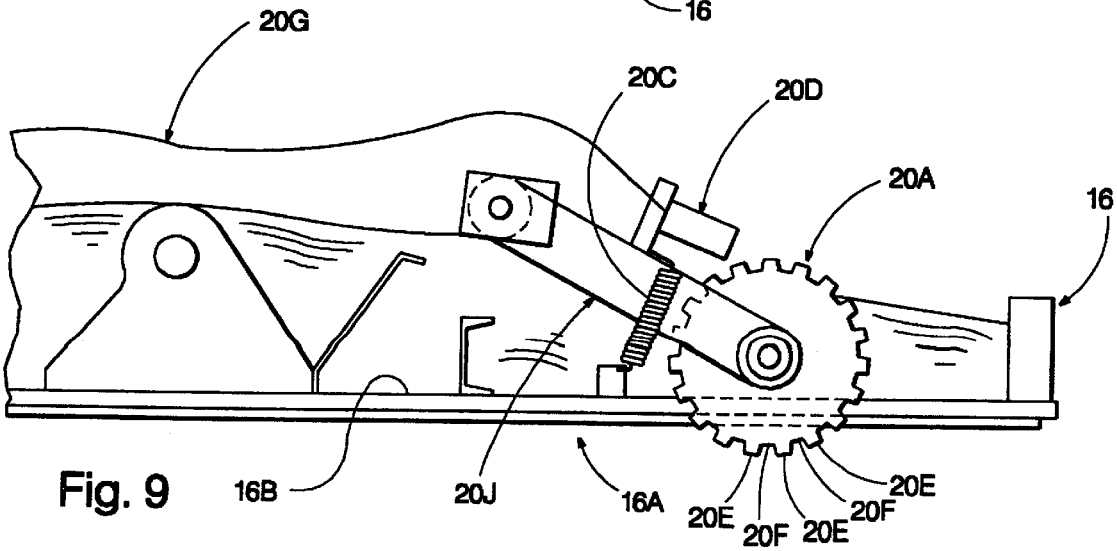
Fig. 9

22
224
30
280
12
216
66
240
218
214
228
220
230
250
235
264
264
235
260
266
262

224
30
280
216
66
240
218
228
12
220
230
250
235
264
264
235
214
260
266
262
264
266
262

224
30
280
216
12
66
240
214
218
220
230
250
235
264
264
235
214
260
266
262

METHOD AND APPARATUS FOR MEASURING THE LENGTH OF A WASTE LOG AND/OR WEIGHT OF WASTE LOG WHILE COMPACTING AND TRANSFERRING THE WASTE LOG FOR TRANSPORT

CROSS-REFERENCE TO RELATED APPLICATION

This application is a continuation of application Ser. No. 09/255,795, filed Feb. 23, 1999; now U.S. Pat. No. 6,138,557, granted Oct. 31, 2000.

BACKGROUND OF THE INVENTION

The present invention relates to a method and apparatus for measuring the length of a waste log and/or for measuring the weight of the waste log while compacting and transferring the waste log for transport.

Waste compaction devices are generally known. Such devices are commonly used at waste transfer stations to receive solid waste material and to compact the solid waste material for transport. Some compaction devices, known as tamping devices, are adapted for use on trailers which transport the waste material to a disposal site (e.g., a land fill, incinerator, and the like). Initially, loose waste material is loaded onto the trailer, and then the tamping device is used to compact the loose waste material while it is already on the trailer. Such tamping devices, however, require the trailer to be present during the entire compaction operation. Also, because the trailer tamping device presses the waste material against the trailer's walls and/or floor, the trailer is subjected to very strong forces and must be reinforced to reduce the likelihood of failure. Such forces nevertheless tend to reduce the useful life of the trailer, when compared to trailers that receive and transport the waste material after compaction only.

In order to avoid the problems associated with tamping devices, efforts have been made to provide compaction devices which perform the compaction process internally and transfer the compacted waste material in log form to the trailer. Such compaction devices generally avoid the problem of exposing the trailer to the compaction forces.

A primary object of compaction devices is to optimize the density of the waste log (i.e., optimize the amount of waste material per unit volume of the waste log). Some conventional compaction devices therefore contain a powerful hydraulic ram which moves through a cylinder to compress the waste material. In particular, the waste material is loaded into the cylinder, and the ram is actuated to compress the waste material and reduce or eliminate voids therein. After compression, the waste material is pushed onto the trailer for transportation to the disposal site. Conventional compaction devices, however, lack any reliable way of automatically determining the length of the waste log and/or weight of the waste log.

Since trailers have limited dimensions, it is desirable to provide a way of automatically determining when the compressed waste log has reached a predetermined maximum length which a particular trailer can accommodate. If the length cannot be readily determined and the waste log ends up being too long, it may become jammed in the trailer, making unloading difficult, time consuming, and expensive. If the waste log is shorter than what the trailer can accommodate, then the trailer's capacity is not being used to its fullest extent. In this regard, the trailer is not being used as efficiently as possible. The waste material left behind eventually must be transported to the disposal site, thus requiring additional trips to the disposal site. This results in unnecessary expenditures of fuel, unnecessary wear-and-tear on the trailers and the tractors which pull them, as well as increased labor costs (drivers, mechanics, and the like). There is consequently a need in the art for a way of automatically determining when the compressed waste log has reached the predetermined maximum length so that the waste log can be cut-off automatically at that length and transported efficiently to the disposal site.

Trailers also have weight restrictions which are imposed by the trailer manufacturer, by law, and/or by a transportation authority (e.g., state departments of transportation or a federal agency). If the waste log becomes too heavy, unloading of some of the compacted waste may become necessary in order to comply with the weight restrictions of the trailer or to avoid a dangerous situation. Unloading of the excess compacted waste, however, is generally time-consuming and highly impractical. Similarly, if the waste log is lighter than what the trailer can accommodate, then the trailer's capacity is not being used to its fullest extent. The waste material left behind eventually must be transported to the disposal site, thus requiring additional trips to the disposal site. This also results in unnecessary expenditures of fuel, unnecessary wear-and-tear on the trailers and the tractors which pull them, as well as increased labor costs. There is consequently a need in the art for a way of automatically determining when the compressed waste log has reached a predetermined maximum weight, to permit termination of the flow of waste material into the waste log and transfer of the waste log onto the trailer.

SUMMARY OF THE INVENTION

A primary object of the present invention is to satisfy the aforementioned needs in the art by providing a method and apparatus for measuring the length of a waste log and/or for measuring the weight of the waste log while compacting and transferring the waste log for transport.

To achieve this and other objects, the present invention provides a compaction and transfer apparatus adapted to measure the length of a waste log during compaction and transfer thereof. The apparatus comprises a compaction chamber, a closure device, a compaction ram, and a movement detector. The compaction chamber is adapted to receive waste material. The compaction chamber has a discharge opening. The closure device is selectively movable into and out of the discharge opening to control the size of the discharge opening. The compaction ram is movable through the chamber to press the waste material against the closure device and thereby provide compaction of the waste material. The movement detector preferably is mounted on the closure device. The movement detector is adapted to detect movement of the waste material through the discharge opening, which movement corresponds to the length of the waste log extending out of the discharge opening.

Also provided by the present invention is a method of measuring the length of a waste log during a compaction and transfer operation. The method comprising the steps of: providing a compaction chamber to accommodate waste material; loading waste material into the compaction chamber; compacting the waste material to form the waste log; opening a discharge opening of the compaction chamber, at least partially, to permit transfer of the waste log out of the compaction chamber; and detecting movement of the waste log through the discharge opening. The movement corresponds to the length of the waste log extending out of the compaction chamber.

The present invention also provides a compaction and transfer apparatus adapted to measure the weight of a waste log during compaction and transfer thereof. The apparatus comprises a compaction chamber, a closure device, a compaction ram, and a weight detector.

The compaction chamber is adapted to receive waste material. The compaction chamber has a discharge opening. The closure device is selectively movable into and out of the discharge opening to control the size of the discharge opening. The compaction ram is movable through the chamber to press the waste material against the closure device and thereby provide compaction of the waste material. The weight detector is adapted to detect a total weight of the waste material in the compaction chamber and any portion of the waste log which extends out through the discharge opening.

Also provided by the present invention is a method of measuring the weight of a waste log during a compaction and transfer operation. The method comprises the steps of: providing a compaction chamber to accommodate waste material; loading waste material into the compaction chamber; detecting an initial weight of the waste material; compacting the waste material to provide a waste log; retracting the compaction ram; loading additional waste material into the compaction chamber; and detecting any incremental increases in the weight of the waste material attributable to the additional waste material and keeping a running total of the initial weight and the incremental increases, the running total corresponding to the weight of the waste log; compacting the waste material and the additional waste material to augment the waste log; and opening, at least partially, a discharge opening of the compaction chamber to permit transfer of the waste log out of the compaction chamber.

The term "waste" is to be broadly construed. It encompasses more than materials which cannot be reused. The term "waste", for example, encompasses materials which are to be transported to, and processed by, a recycling facility.

The above and other objects and advantages will become more readily apparent when reference is made to the following description taken in conjunction with the accompanying drawings.

BRIEF DESCRIPTION OF THE DRAWINGS

FIG. 8 is a plan view of a closure device according to the preferred embodiment shown in FIGS. 1–7.

FIG. 9 is a fragmentary side view of the closure device shown in FIG. 8, taken along line A—A of FIG. 8.

DESCRIPTION OF PREFERRED EMBODIMENTS

Figure 1:
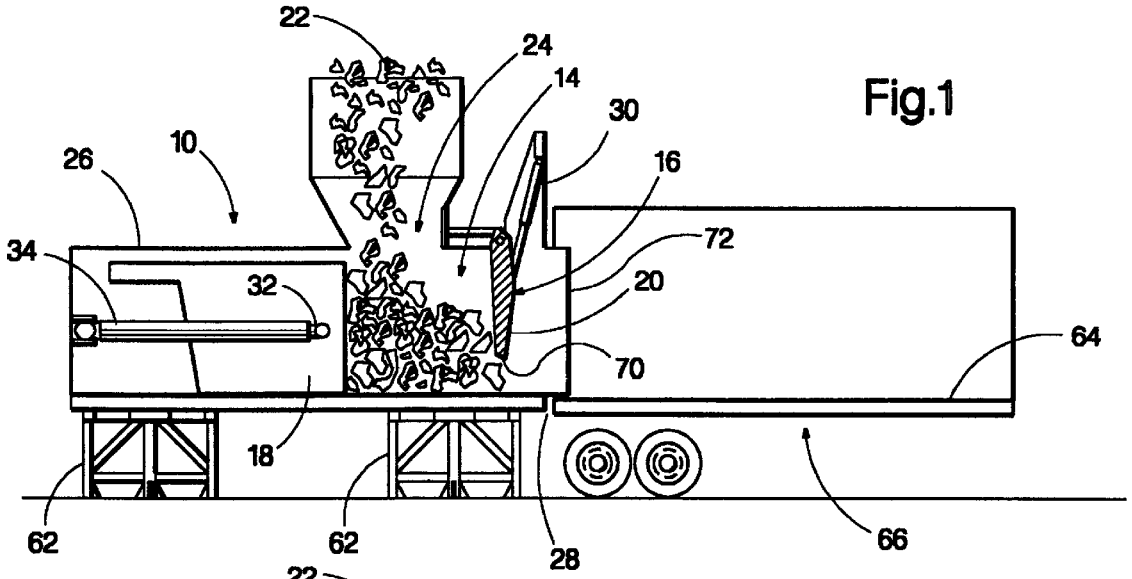
FIGS. 1–7 are partial cross-sectional elevations of a compaction and transfer apparatus, in different processing stages, according to a preferred embodiment of the present invention.
Figure 2:
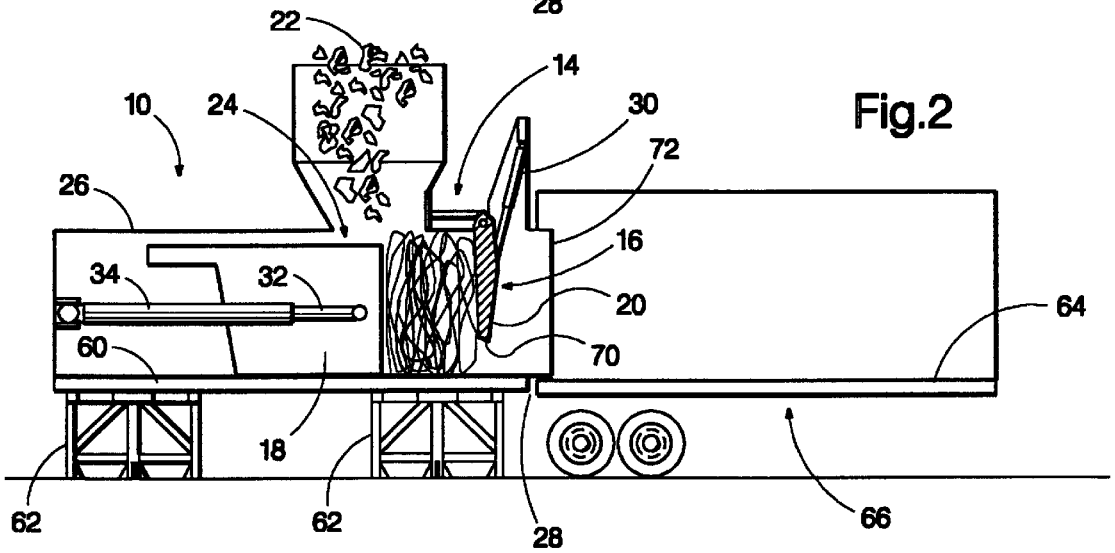

FIGS. 1–7 illustrate a compaction and transfer apparatus 10 according to a preferred embodiment of the present invention. The compaction and transfer apparatus 10 is adapted to measure the length L of a waste log 12 during compaction and transfer thereof. The apparatus 10 comprises a compaction chamber 14, a closure device 16, a compaction ram 18, and a movement detector 20.

The compaction chamber 14 is adapted to receive loose waste material 22. In particular, an entrance 24 is provided at the top 26 the compaction chamber 14. While the entrance 24 need not be located at the top 26 of the compaction chamber 14, such positioning is preferred because it facilitates gravity feeding of the loose waste material 22 into the entrance 24. The entrance 24 preferably communicates with the bottom discharge end 25 of a waste material hopper 26.

A discharge opening 28 is provided in the compaction chamber 14. The closure device 16 is selectively movable into and out of the discharge opening 28 to control the size of the discharge opening 28.

As illustrated in FIGS. 8 and 9, the movement detector 20 preferably is mounted on the closure device 16. This tends to keep the movement detector 20 in contact with the waste material 22. The movement detector 20, however, need not be mounted on the closure device 16. Other suitable mounting positions for the movement detector 20 include, for example, the floor 60 of the chamber 14, or the lateral walls (not shown) of the compaction chamber 14. Preferably, such mounting of the movement detector 20 is performed at or near the discharge opening 28 so that the movement of the waste material 22 at the detector 20 corresponds more accurately with the length of the log 12. In situations where the movement detector 20 is mounted on the lateral walls, it should be mounted, for example, below the range of motion of the closure device 16 to avoid interfering with the closure device 16 and to keep the closure device 16 from blocking the movement detector's access to the log 12. The mounting position of the movement detector 20 also should be selected so as to avoid valleys or other locations in the chamber 14 where the waste material 22 may collect and remain stationary during movement of the waste log 12.

The movement detector 20 is adapted to detect movement of the waste material 22 through the discharge opening 28, preferably during compaction of the waste material 22. The movement detected by the movement detector 20 corresponds to the length L of the waste log 12 extending out of the discharge opening 28.

The exemplary movement detector 20 includes a redundant arrangement of three rotatable wheels 20A. Two of the rotatable wheels 20A are mounted toward opposite lateral sides of the closure device 16. Mounted medially between those two wheels 20A is the third rotatable wheel 20A.

Preferably, as shown in FIG. 9, each wheel 20A has a sprocket-like circumferential portion 20B. The circumferential portion 20B projects out through a waste-engaging surface 16A of the closure device 16. Preferably, each wheel 20A is pivotally mounted to the outside surface 16B of the closure device 16, with a spring 20C biasing each wheel 20A out through the waste-engaging surface 16A. A pivotable arm 20J preferably secures each wheel 20A to the outside surface 16B. The circumferential portion 20B engages the waste log 12 so that movement of the waste log 12 through the discharge opening 28 causes the wheels 20A to rotate.

A proximity switch 20D preferably is mounted near the circumferential portion 20B of each wheel 20A. The proximity switch 20D can be implemented using commercially available switches, preferably optical or magnetic switches, which are capable of detecting rotation of the wheels 20A. Such proximity switches, for example, can detect transitions between teeth 20E and valleys 20F of the circumferential portion 20B as the wheels 20A rotate. Signals indicative of such transitions are provided by the proximity switch 20D associated with each wheel 20A to an associated communication line 20G. Each proximity switch 20D thus represents an exemplary conversion device which is adapted to convert mechanical rotation of a respective wheel 20A into a signal indicative of such mechanical rotation.

While the exemplary movement detector 20 includes three wheels 20A, it is understood that the invention is not limited to such an arrangement. The present invention may be practiced using only one such wheel 20A, two wheels 20A, or more than three wheels 20A. Likewise, the movement detector 20 is not limited to implementations using the exemplary wheel-based configuration, nor is it limited to conversion devices in the form of a proximity switch 20D.

Other movement detectors 20, with or without proximity switches 20D and with or without rotatable wheels 20A can be used.

Preferably, the closure device 16 is hydraulically actuated by a hydraulic arm 30. When the hydraulic arm 30 is extended, the closure device 16 extends across the majority of the discharge opening 28. The waste material 22 thus becomes trapped in the compaction chamber 14. When the hydraulic arm 30 is retracted, the closure device 16 pivots away from the discharge opening 28 to provide a substantially unobstructed path through the discharge opening 28.

The compaction ram 18 is movable through the chamber 14 to press the loose waste material 22 against the closure device 16 and thereby provide compaction of the waste material 22. The compaction ram 18 preferably is hydraulically actuated for extension and retraction by a hydraulic piston 32 and cylinder 34. The present invention, however, is not limited to such actuation of the compaction ram 18. To the contrary, other actuation devices, such as electrically powered actuators, pneumatic actuators, and the like, can be used instead of, or in addition to, the exemplary hydraulic piston 32 and cylinder 34.

Notably, the compaction ram 18 is arranged in the compaction chamber 14 so that, during compaction (i.e., when the piston 32 is hydraulically extended), the entrance 24 is at least partially, and preferably completely, blocked by the ram 18. This is a particularly useful feature for arrangements of the apparatus where the hopper 26 is located inside a building and the discharge opening 26 opens to the outside of the building. By extending the ram 18 so that it blocks the entrance 24, the apparatus 10 prevents trespassers from entering the building through the chamber's entrance 24.

Figure 10:
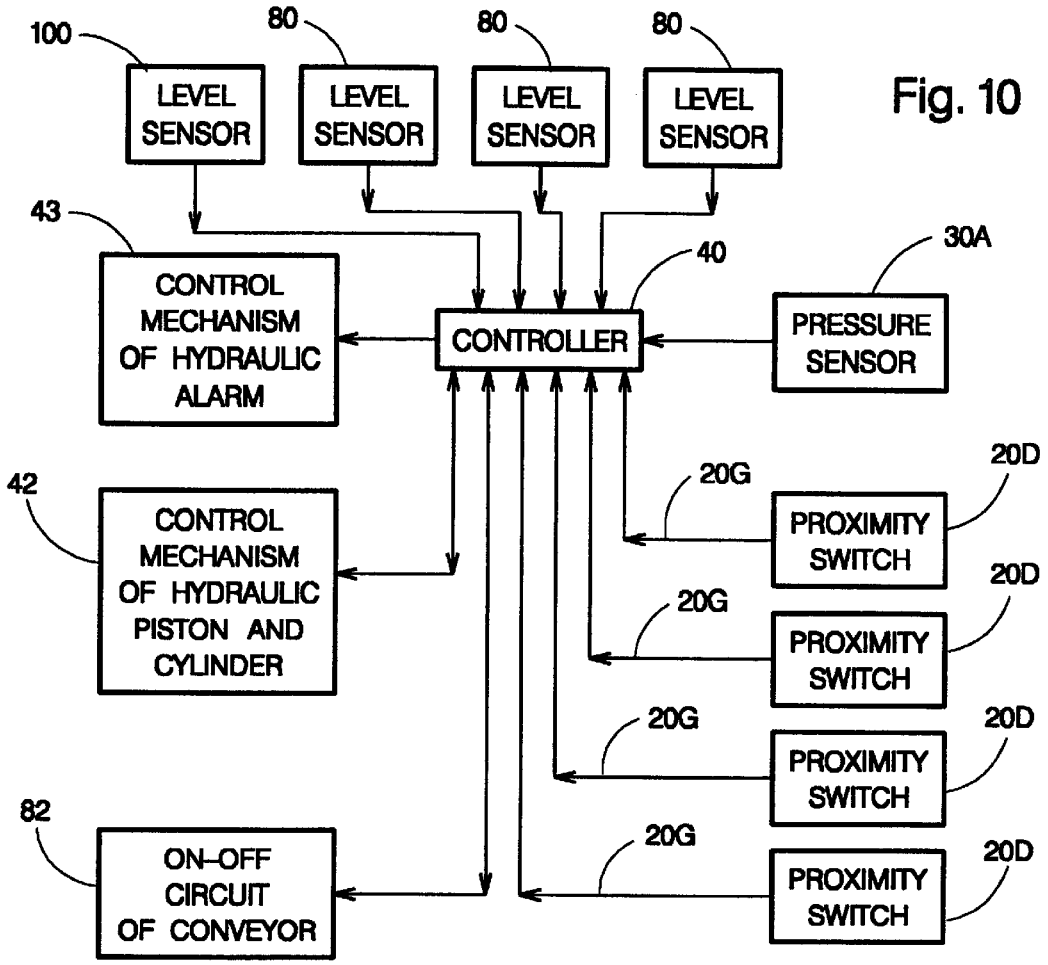
FIG. 10 is a block diagram illustrating a preferred control arrangement according to the preferred embodiment shown in FIGS. 1–9.

As shown in FIG. 10, a controller 40 preferably is connected to the movement detectors via the communication line(s) 20G. The controller 40 can be implemented using a suitably programmed computer device (e.g., a microprocessor, minicomputer, and the like) or using a suitably configured programmable logic circuit (PLC). By programming or otherwise suitably configuring the controller 40, the controller 40 is adapted to determine the length L of the waste log 12 based on the signals indicative of mechanical rotation from the proximity switch(es) 20D. Because the diameter of each wheel 20A is known, as is the spacing between the teeth 20E, the length may be determined based upon receipt of the signals indicative of the detection of each tooth 20E.

Preferably, the controller 40 is electrically connected to a control mechanism 42 of the hydraulic piston 32 and cylinder 34, and is suitably programmed or otherwise configured to control movement of the ram 18 through the chamber 14.

According to an exemplary implementation, the signal indicative of mechanical rotation is provided in the form of electrical pulses from the proximity switch(es) 20D. The controller 40 is adapted to detect and count the electrical pulses on the communication line(s) 20G, each pulse corresponding to a transition between a tooth 20E and a valley 20F. Since such transitions occur only in response to rotation of the wheel(s) 20 when the waste log 12 is being moved, the number of pulses received by the controller 40 is quantitatively dependent upon the distance moved by waste log 16 through the discharge opening 28. The controller 40 therefore is adapted to quantify movement of the waste log 12 through the discharge opening 28. Since this movement corresponds to the length L of the waste log 12 outside of the discharge opening 28, the controller 40 is adapted to detect, based on such movement, the length L of the waste log 12.

The controller 40 likewise can be programmed or otherwise suitably configured to compare a detected movement of the waste log 12, as determined by the movement detector 20, to a predetermined value of movement associated with a maximum length L of the waste log 12. Based upon this comparison, the controller 40 can provide an appropriate visual or audible indication to a user when the maximum length L of the waste log 12 has been achieved. In addition, or alternatively, the controller 40 is adapted by programming or otherwise to effect opening of the closure device 16 and fill extension of the ram 18 when the detected movement corresponds to the predetermined value of movement associated with the maximum length L. The controller 40, in this regard, may be electrically connected to a control mechanism 43 of the hydraulic arm 30.

Preferably, the closure device 16 is at least part of an automatic density regulator. The automatic density regulator is controlled by the controller 40 or by a separate and distinct controller (not shown) to provide the waste log 12 with a relatively constant density. In the exemplary embodiment, the automatic density regulator is defined by the combination of the controller 40, the control mechanism 43, and the closure device 16, wherein the controller 40 is programmed or suitably configured to selectively open and close the closure device 16 as needed to achieve the waste log 12 of relatively constant density.

According to the preferred implementation of the automatic density regulator, the controller 40 is programmed or suitably configured to cause the closure device 16 to initially obstruct a majority of the discharge opening 28. Obstruction by the closure device 16 continues until the pressure exerted by the waste material 22 against the closure device 16 as measured at arm 30 as a result of compaction by the compaction ram 18 reaches a first predetermined threshold. The controller 40 is further programmed or suitably configured to move the closure device 16 out of the discharge opening 28 until the closure device 16 achieves a predetermined angle with respect to the discharge opening 28, or alternatively, until the pressure on the closure device 16 drops to a second predetermined threshold.

The second predetermined threshold is a lower pressure than the first predetermined threshold. Preferably, the first predetermined threshold is about 2,000 pounds per square inch (psi) (e.g., in the hydraulic arm 30), and the second predetermined threshold is about 1,500 psi (e.g., in the hydraulic arm 30). A pressure-indicative signal can be provided to the controller 40 by a suitable pressure sensor 30A which is exposed to the hydraulic fluid of the hydraulic arm 30. Alternative sensor arrangements can be provided for other actuation arrangements.

It also should be understood that the invention is not limited to the exemplary threshold values. Such values may be different depending on the particular needs of the user, as well as the configuration, durability, and the like associated with the particular implementation of the present invention. Such values also may depend on the particular waste material 22 being processed.

The controller 40, in providing the automatic density regulator, is further programmed or suitably configured to gradually bring the closure device 16 back into the discharge opening 28. This gradual closure of the discharge opening 28 continues until the pressure returns to the first predetermined threshold. The controller 40 then, through programming or by virtue of a suitable configuration of the controller 40, causes the closure device 16 to repetitively execute the movement out of the discharge opening 28 and then the movement gradually into the discharge opening 28 as the pressure fluctuates between the first and second predetermined thresholds. Alternatively, the controller 40 can be programmed or suitably configured to cause the closure device 16 to repeat the movement out of the discharge opening 28 to the predetermined angle when the pressure increases to the first predetermined threshold and to repeat the gradual movement into the discharge opening 28 when the pressure drops to the second predetermined threshold. In either case, the waste log is discharged with a relatively constant density. An additional example of automatic density regulation is shown in U.S. Pat. No. 4,817,520 to Brown et al., the disclosure of which is incorporated herein by reference.

Figure 11:
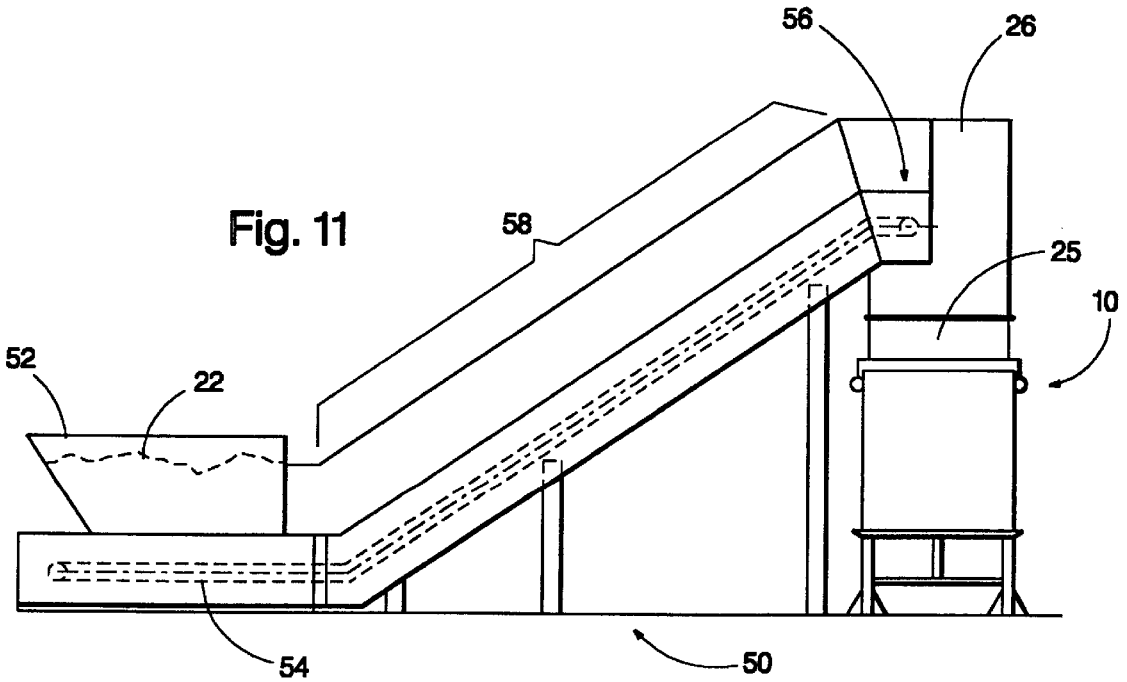
FIG. 11 is a side view of the embodiment shown in FIGS. 1–10, including a conveyor system thereof.

Preferably, as illustrated in FIG. 11, the apparatus 10 further includes a conveyor system 50 adapted to convey the loose waste material 22 to the hopper 26. The conveyor system 50 includes an input hopper 52, a belt conveyor 54, and a drop-off zone 56. The loose waste material 22 is unloaded into the input hopper 52. From the input hopper 52, the loose waste material 22 is carried by the belt conveyor 54, initially horizontally and then up an incline portion 58, to the drop-off zone 56. The drop-off zone 56 preferably is elevated so that the waste material 22 can drop into the hopper 26 under the influence of gravity. The resulting arrangement advantageously avoids the need to load and unload at different levels. That is, both the unloading and loading trucks can be at ground level. This avoids the need to provide an elevated truck-accommodating platform or excavations which would otherwise be required for a two-level arrangement. Since such site preparation becomes unnecessary, the apparatus 10 with the conveyor system 50 provides a self-contained compaction apparatus which is relatively easy to relocate.

As shown in FIGS. 1–7, the floor 60 of the compaction chamber 14 preferably is supported by a framework 62 or otherwise at a level which matches the anticipated level of floors 64 of the trailers 66 which are to transport the waste logs 12 to their destination. In order to facilitate transfer of the waste log 12 into the trailer 66, the discharge opening 28 is dimensioned so that its circumference and a distal tip 70 of the closure device 16 can be inserted partially into the trailer 66.

The apparatus 10 advantageously is capable of performing a method of measuring the length L of the waste log 12 during a compaction and transfer operation. The method preferably is carried out under the control of the controller 40. The method includes the initial step of retracting the compaction ram 18 in the compaction chamber 14 to accommodate waste material 22. Preferably, this initial step is achieved by the piston 32 and cylinder 34 in response to commands from the controller 40.

Next, as shown in FIG. 1, waste material 22 is loaded into the compaction chamber 14 (e.g., through the entrance 24). If the hopper 26 already contains loose waste material 22, then the loading step is carried out automatically by gravity as the ram 18 is retracted. If there is not enough waste material 22 in the hopper 26 to fill the void in the chamber 14 left by the ram 18, the conveyor system 50 can be activated to feed more waste material into the hopper 26. Activation of the conveyor system 50 can be manual or automatic.

Figure 5:
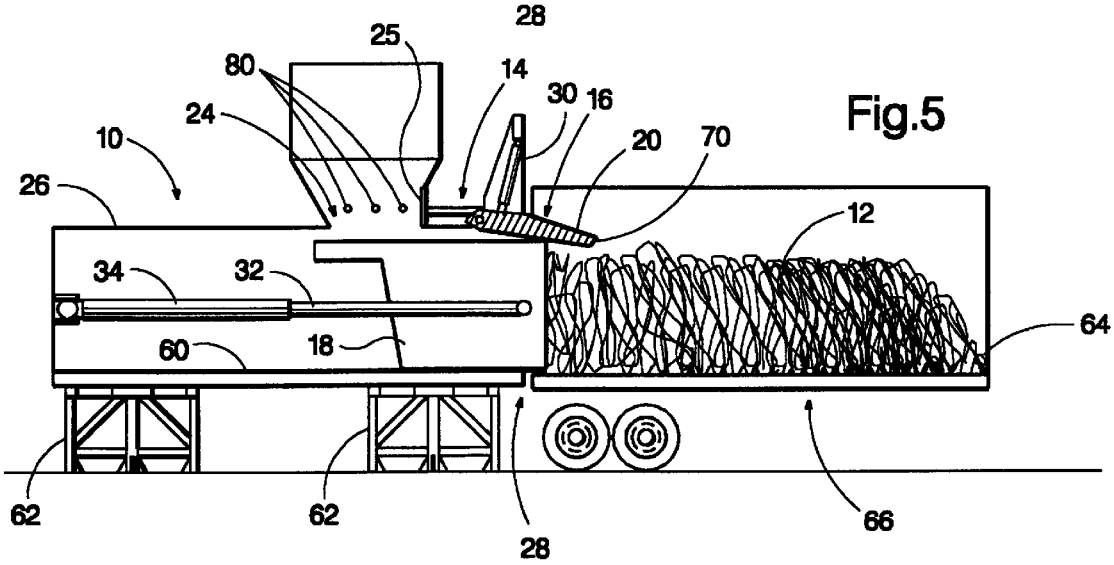
Figure 6:
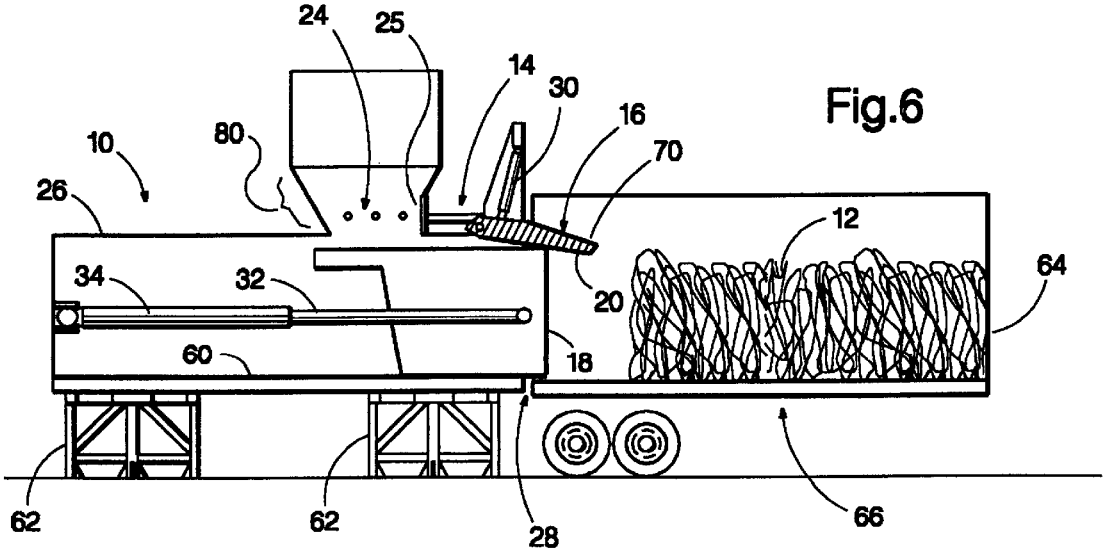
Figure 7:
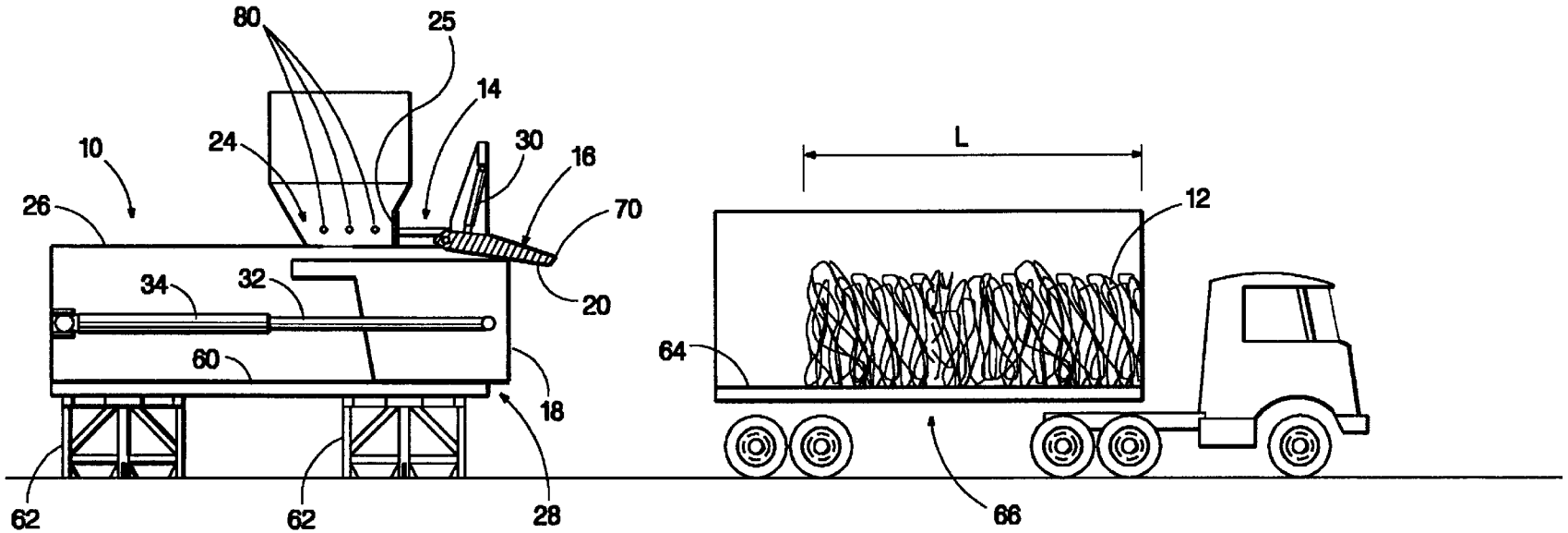

As illustrated in FIGS. 5–7, at least one level sensor 80 (preferably three level sensors 80) can be provided at the entrance 24 of the chamber 14. Each level sensor 80 detects whether the waste material 22 is present at the entrance 24 and provides an output signal indicative thereof. Commercially available optical sensors can be used as the level sensors 80. In the optical sensor-based arrangement, a beam of light is directed across the entrance 24 so that any waste material 22 present at the entrance 24 interrupts the beam. Each optical sensor 80 then provides an output signal indicative of whether the beam has been interrupted.

The output signals from the level sensors 80 can be applied to an on-off circuit 82 of the conveyor system 50. Preferably, the on-off circuit 82 activates the conveyor belt 54 when the output signals from the optical sensors 80 indicate that there is no waste material 22 at the entrance 24 (i.e., when none of the light beams are interrupted), and deactivates the conveyor belt 54 when waste material 22 is detected at the entrance 24 (i.e., when at least one of the light beams is interrupted).

In addition or alternatively, as shown in FIG. 10, the output signals from the level sensors 80 can be applied to the controller 40. The controller 40, in response to such output signals, can control the conveyor system's on-off circuit 82 in the absence of any direct connection between the circuit 82 and the output signals from the sensors 80. The control of the conveyor system 50 provided by the controller 40 also can be made dependent upon the location of the ram 18 along the length of the compaction chamber 14.

Upon detecting the presence of waste material 22 at the entrance 24 while the ram 18 is fully retracted, the controller 40 determines that the chamber 14 is full of waste material. The controller 40, based on this determination, actuates the ram 18 via the control mechanism 42. As the piston 32 extends out of the cylinder 34, the ram 18 begins to move to the right in FIG. 2. This movement is demonstrated by the difference between FIGS. 1 and 2. As the ram 18 moves to the right in FIG. 2, the waste material is compacted to form the waste log 12. A desired amount of compaction is eventually achieved by movement of the ram 18 (i.e., the log achieves a desired density).

Figure 3:
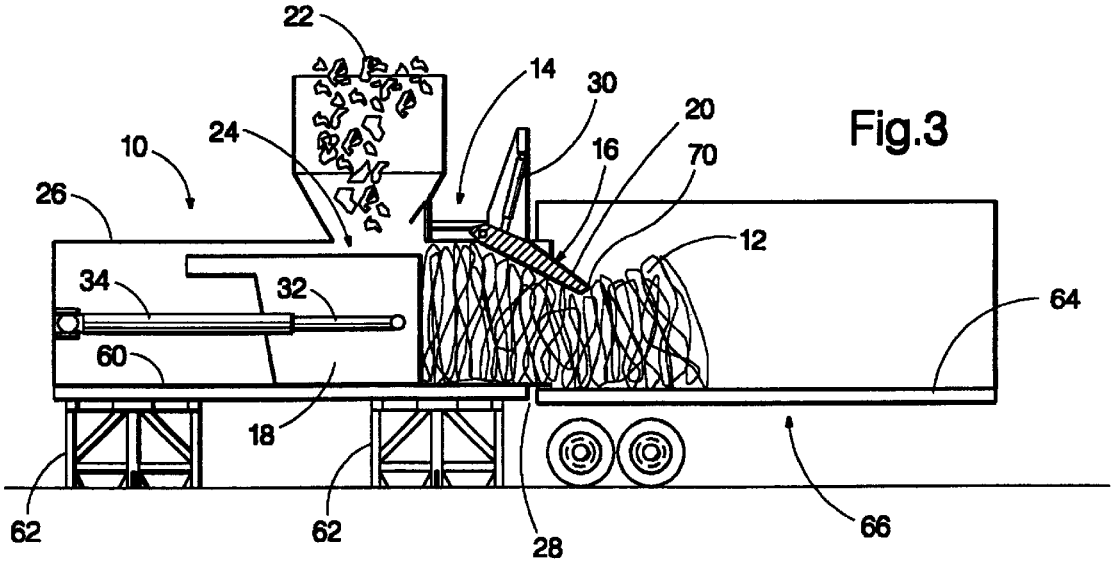

As illustrated in FIG. 3, the discharge opening 28 of the compaction chamber 14 is opened, at least partially, when the desired density is achieved to permit transfer of the waste log 12 out of the compaction chamber 14. Preferably, the waste log 12 is transferred directly onto a trailer 66 which, in turn, will be used to transport the waste log 12 to its destination.

As the waste log 12 exits the chamber 14 through the discharge opening 28, its movement is detected by the movement detector 20. This movement, as indicated above, corresponds to the length of the waste log 12 extending out of the compaction chamber 14.

The method further comprises, according to a preferred implementation, the steps of comparing a detected amount of movement, as detected by the movement detector 20, to a predetermined amount of movement corresponding to a maximum length of the waste log. When the detected amount of movement equals the predetermined amount of movement, the closure device 16 is pivoted out of the discharge opening 28, as illustrated in FIGS. 5–7, and the ram 18 is fully extended to discharge the waste log 12 onto the trailer 66 before the length of the log 12 exceeds the maximum length which can be tolerated by the trailer 66.

Figure 4:
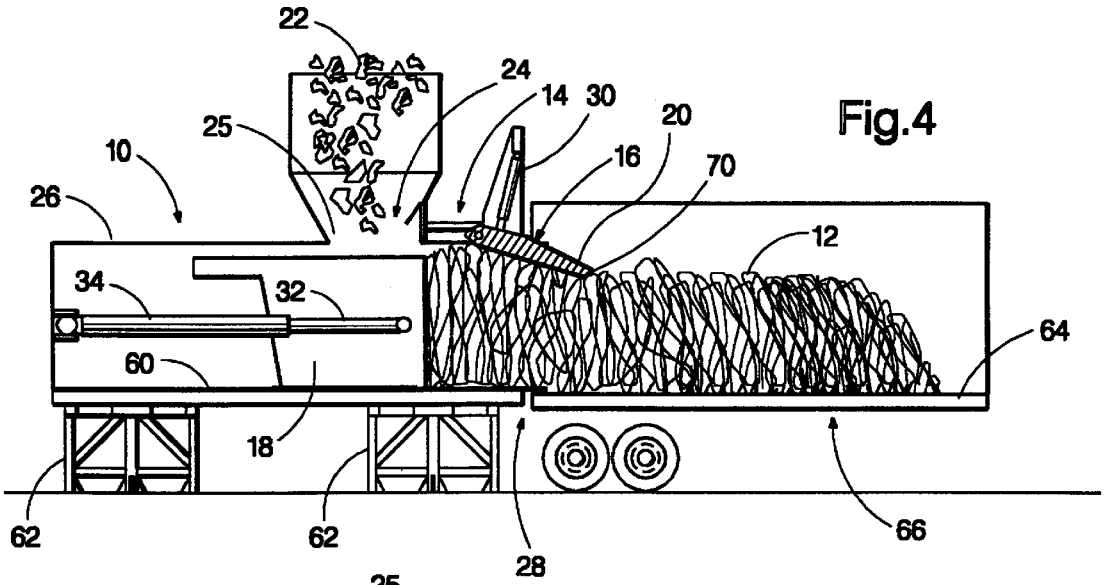

Preferably, as illustrated in FIG. 4, the density of the waste log 12 is regulated by selectively restricting and opening the discharge opening 28. In doing so, the determination of whether to restrict or further open the discharge opening 28 is made dependent upon the pressure exerted by the waste log 12 against the closure device 16 at the discharge opening 28 and/or the angular relationship of the closure device 16 to the discharge opening 28. While the pressure can be detected in many ways, it preferably is determined based on the pressure of the hydraulic fluid in the hydraulic arm 30. This pressure is indicative of the compaction density.

As indicated above, the density of the waste log 12 can be regulated by the controller 40, the control mechanism 43, and the closure device 16, in response to a signal from the pressure sensor 30A. Alternatively, the automatic density regulation can be provided in a pressure-responsive manner by a hydraulic circuit with a suitably configured pressure control mechanism. In this regard, when the first predetermined threshold is achieved, hydraulic pressure at the hydraulic arm 30 can be released to permit opening of the closure device 16. The same pressure control mechanism can be made responsive to positioning of the closure device 16 and/or pressure in the hydraulic arm 30 so that additional hydraulic pressure is applied to the arm 30 either in response to detection of the second, lower predetermined threshold or in response to detection of the predetermined angle between the closure device 16 and the discharge opening 26.

In addition, or alternatively, the compaction and transfer apparatus 10 can include a weight detector 100 (as shown in FIG. 10) adapted to detect the weight of the waste material 22. The method described above, therefore, can further include the steps of detecting the weight of the waste material 22 and terminating the step of loading waste material 22 when the weight reaches a predetermined weight threshold.

Preferably, the controller 40 is programmed or otherwise configured to prevent additional waste material 22 from being loaded into the compaction chamber 14 and to cause the compaction ram 18 to discharge the waste log 12 through the discharge opening 28, when the total weight of the waste material in the compaction chamber 14 and any portion of the waste log 12 extending out of the compaction chamber 14 reaches a first predetermined weight.

Alternatively, the weight detector 100 can be connected directly to the control mechanism 42 of the piston 32 and cylinder 34, and/or to the control mechanism 43 of the hydraulic arm 43. When such a direct connection is provided, the weight detector 100 automatically causes the compaction ram 18 to discharge the waste log 12 through the discharge opening 28, without communicating with the controller 40, when the total weight of the waste material 22 in the compaction chamber 14 and any portion of the waste log 12 extending out of the compaction chamber 14 reaches the first predetermined weight.

The control mechanisms 42,43 can be implemented using conventional hydraulic control mechanisms, an example of which is disclosed in the aforementioned U.S. Pat. No. 4,817,520 to Brown et al., the disclosure of which is incorporated herein by reference.

Figure 12:
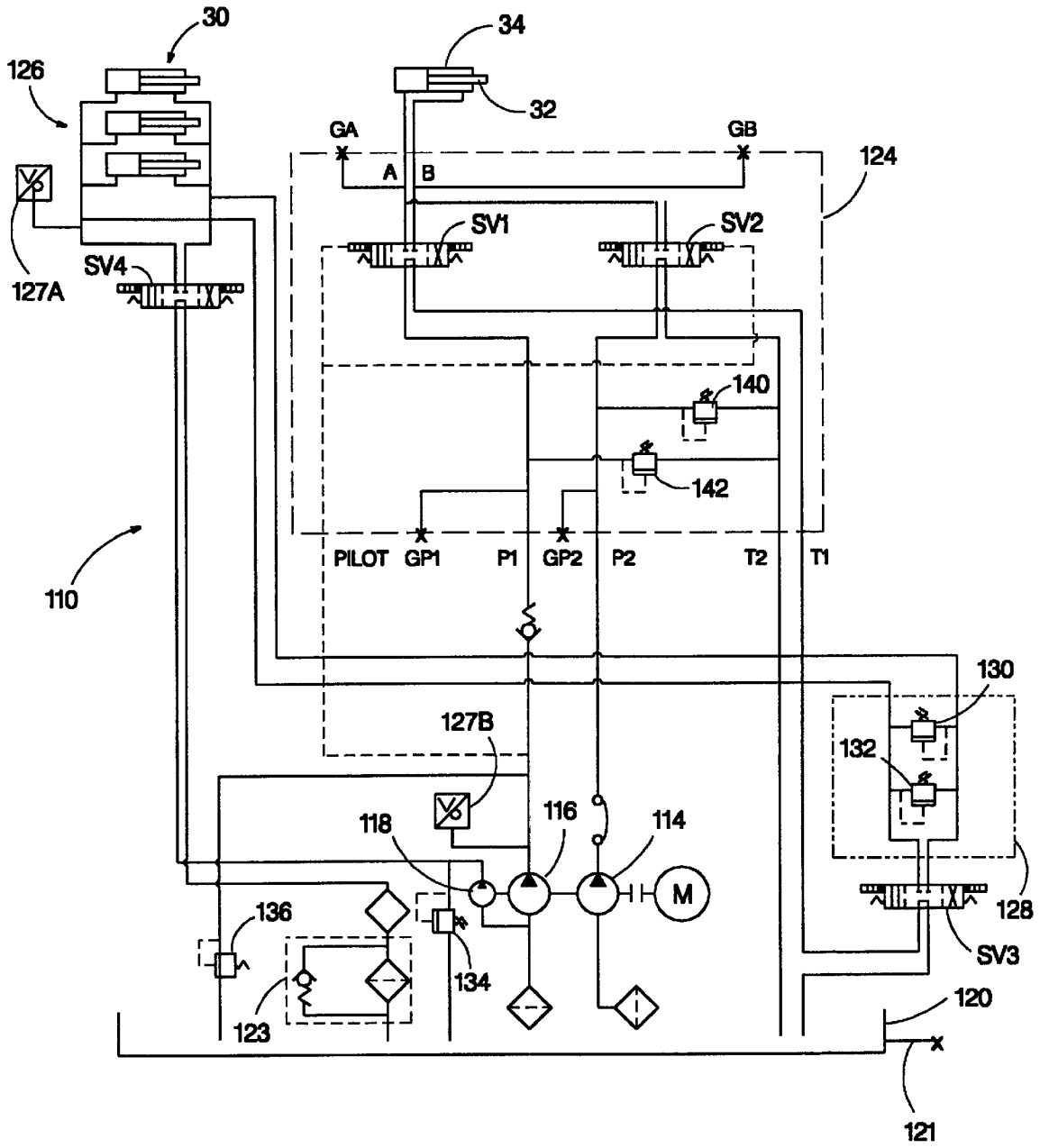
FIG. 12 is a hydraulic circuit diagram of a hydraulic circuit which can be used in connection with the embodiment shown in FIGS. 1–11.

FIG. 12 illustrates an exemplary hydraulic circuit 110 which is particularly well-suited for use in connection with the embodiment illustrated in FIGS. 1–11. The present invention, however, is not limited to the exemplary circuit 110, inasmuch as similar results can be achieved using numerous other configurations.

The hydraulic circuit 110 includes a 40 horsepower electrically powered motor M. The motor M has an output shaft connected, at least indirectly, to a 50 gallon/minute hydraulic pump 114, a 25 gallon/minute hydraulic pump 116, and an 12 gallon/minute hydraulic pump 118. All three pumps 114,116,118 have inputs connected to a source of hydraulic fluid, such as a 150 gallon reservoir 120. A plug 121 can be provided in the reservoir 120 to facilitate draining thereof.

A manifold 124 with an unloading valve arrangement is connected to two of the pumps 114,116. The other pump 118 (12 g/m) is connected, through a solenoid valve SV4, to three hydraulic actuators 126 which can be used to implement the hydraulic arm 30 of the closure device 16. A line filter 123 is provided between the solenoid valve SV4 and the reservoir 120. A 10 micron return line filter preferably constitutes the line filter 123.

A pressure sensor 127A is provided at the input line to the hydraulic actuators 126. The pressure sensor 127A can serve as the pressure sensor 30A described above. Preferably, the pressure sensor 127A converts a detected pressure to a voltage indicative of the pressure. Another pressure sensor 127B is provided at the output from the 25 g/m pump 116.

The actuators 126 also are connected hydraulically to a relief mechanism 128 consisting primarily of two relief valves 130,132. In addition, another relief valve 134 is provided between the output from the pump 118 and the reservoir 120.

An air bleed-off valve 136 is connected between the output from the pump 116 and the reservoir 120. Preferably, another solenoid valve SV3 is connected between the actuators 126 and the manifold 124.

The manifold 124 is connected hydraulically to the piston 32 and cylinder 34 of the compaction ram 18. The manifold 124 preferably includes two solenoid valves SV1 and SV2. Like the solenoid valves SV3 and SV4, the solenoid valves SV1 and SV2 are spring-biased toward a closed position and can be actuated alternatively into either a forward flow position or a reverse flow position. The manifold 124 also includes two relief valves 140,142. Preferably, the relief valves 140,142 are set open at 1000 psi, whereas the relief valves 130,132 are set to open at 2500 psi. The manifold 124 preferably includes eleven ports PILOT, GP1, P1, GP1, P2, T1, T2, GB, A, B, and GA.

Since one having ordinary skill in the art would readily appreciate how the exemplary hydraulic circuit 10 operates based on the foregoing description, as well as the schematic representation in FIG. 12, no further description of the circuit's operation is necessary.

The embodiment illustrated in FIGS. 1–12 advantageously measures the length of the waste log 12, and if desired, can automatically discharge the log 12 when it reaches a maximum length. There may be situations, however, where the maximum weight of the waste log 12 is exceeded before the maximum length can be achieved. In those situations, it may not be necessary to measure the length of the log 12. Instead, it is more desirable to provide an indication or control of the compaction and transfer operation based on the waste log's weight.

Figure 13:
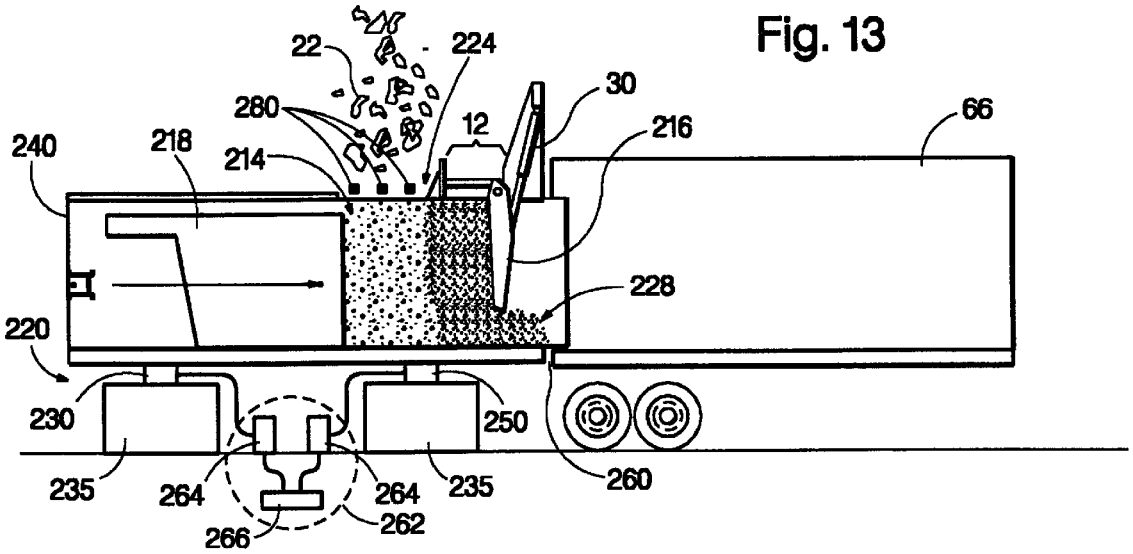
FIGS. 13–15 are partial cross-sectional elevations of a compaction and transferring apparatus according to an alternative embodiment of the present invention.
Figure 14:
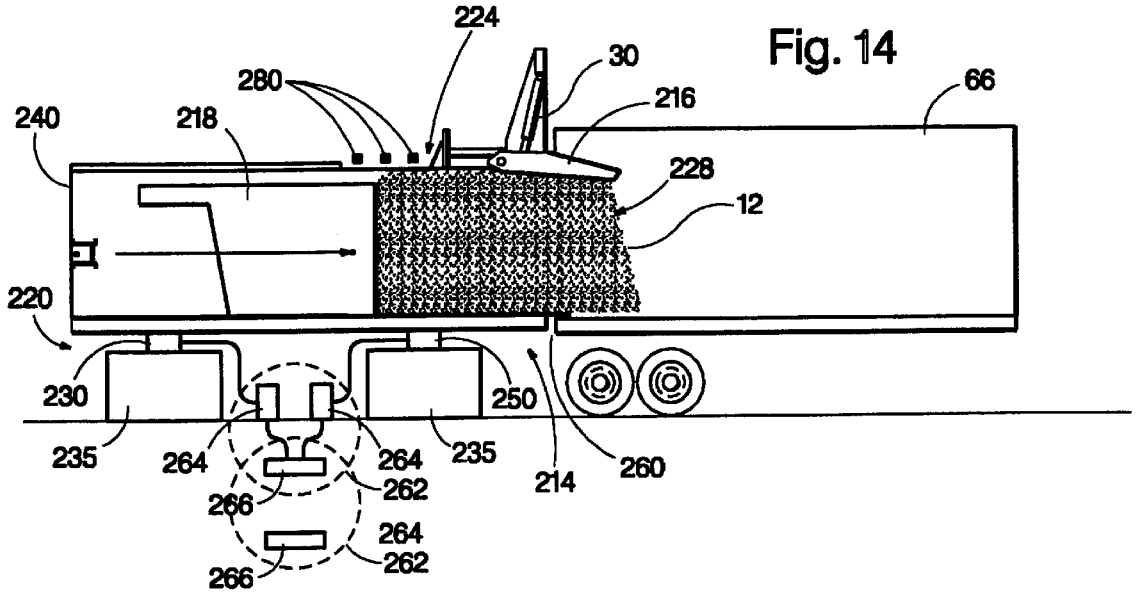
Figure 15:
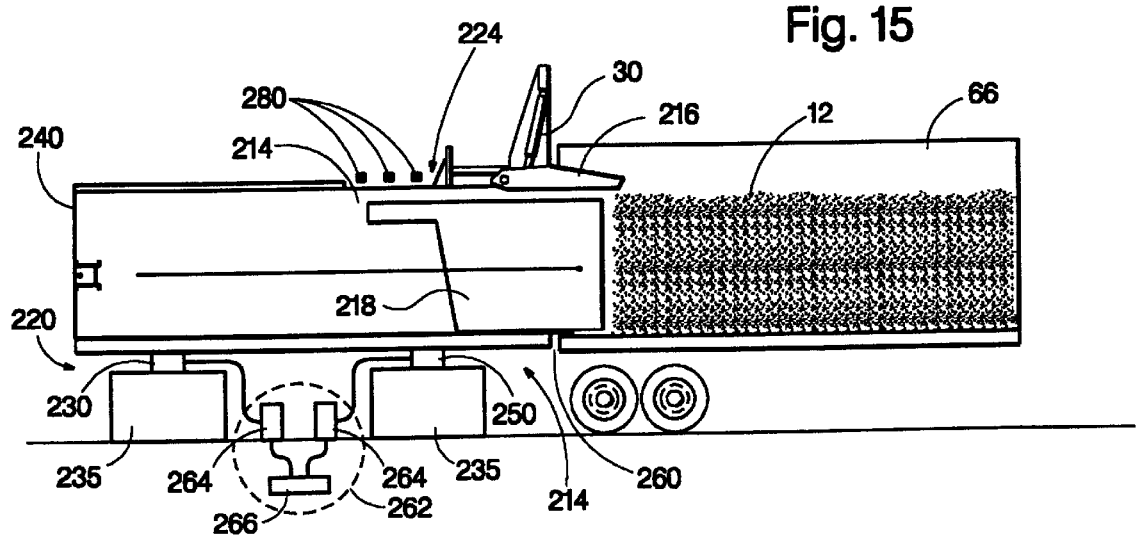

An alternative embodiment of the present invention therefore can be provided with weight measuring capabilities, but need not include the movement sensor 20 described above. As shown in FIGS. 13–15, such an alternative embodiment includes a compaction and transfer apparatus 200. The apparatus 200 may include some or all of the features described above in connection with the exemplary apparatus 10.

The apparatus 200 is adapted to measure the weight of the waste log 12 during compaction and transfer thereof. Included with the apparatus is a compaction chamber 214,a closure device 216, a compaction ram 218, and a weight detector 220. Level sensors 280 are provided at the entrance 224 to the chamber 214. The level sensors 280 may be identical or similar to the level sensors 80 described in the previous embodiments.

The compaction chamber 214 is adapted to receive waste material via the entrance 224. A discharge opening 228 is provided in the chamber 214. The closure device 216 is selectively movable into and out of the discharge opening 228 to control the size of the discharge opening 228.

The compaction ram 218 is movable through the chamber 214 to press the waste material 22 against the closure device 216 and thereby provide compaction of the waste material 22. The weight detector 220 is adapted to detect a total weight of the waste material 22 in the compaction chamber 214 and any portion of the waste log 12 which extends out through the discharge opening 228.

Preferably, the weight detector 220 includes two load cells 230 supporting the compaction and transfer apparatus 200 at or near a first longitudinal end 240 thereof. Only one of the load cells 230 is visible in FIGS. 13–15. The visible one of the load cells 230 obstructs the view of the other load cell in the viewing direction of FIGS. 13–15. Each of the load cells 230 is adapted to provide a signal indicative of the amount of weight supported by the respective load cell 230. An additional pair of similarly situated load cells 250 support the compaction and transfer apparatus 200 at or near a second longitudinal end 260 of the apparatus 200. Each of these load cells 250 is adapted to provide an additional signal indicative of the amount of weight supported by the two additional load cells. The load cells 230,250 can be positioned between the apparatus 200 and a set of support platforms 235. While multiple load cells 230,250 are provided in the preferred embodiment, it is understood that a single load cell can be used if such a load cell is configured to provide adequate stability and balancing of the apparatus 200. Likewise, the entire apparatus 200 need not be supported only by load cells in situations where accuracy is not so critical or appropriate calibration measures are taken to compensate for the weight which is being supported by other means.

It is understood that, in the multiple load cell context, the number of load cells is not limited to four. To the contrary, the present invention can be practiced using any number of load cells depending on the particular needs of the user and the physical structure of the apparatus 200.

The signals from the load cells 230 and 250 are applied to a controller 262. The controller 262 can be the same controller 40 described above, or alternatively, can be provided using a different control device. For purposes of this disclosure, the term "controller" is understood to include not only devices which exercise control over the compaction and transferring operations, but also those which merely control a display device, an audible weight indicator, or data recorder/reader.

In the preferred embodiment, the controller 262 includes a reader unit 264 for each pair of load cells 230,250, and a totaling unit 266 adapted to calculate a total weight based on a sum of the outputs from the plurality of load cells 230,250. The totaling unit 266 can be implemented using an appropriately programmed logic circuit, microcomputer, or the like.

Preferably, the controller 262 is adapted to determine the weight of the waste log 12 based on each signal and each additional signal from the load cells 230,250, respectively. The determination can be made, for example, by performing the steps of: summing, if more than one load cell is provided, the weights represented by each signal prior to loading of any waste material 22 into the compaction chamber 214, to determine an empty weight of the compaction and transfer apparatus 200; after any subsequent additions of waste material 22 and prior to compaction of such subsequent additions, sampling the signal(s) indicative of weight to determine an incremental increase in weight of the compaction and transfer apparatus 200 attributable to such additions of waste material, and if more than one load cell (e.g., 230,250) is provided, summing all such incremental increases for each addition of waste material; and keeping a running total of the incremental increases. The running total corresponds to the weight of the waste log 12.

The controller 262 also is programmed or suitably configured to compare the detected weight of the waste material 22 and any portion of the waste log 12 extending out through the discharge opening 228, as determined by the weight detector 220 (e.g., load cells 230,250), to a predetermined value of weight associated with a maximum weight of the waste log 12. An indication can be provided visually or audibly when the comparison results in a match.

In addition, or alternatively, the controller 262 may be programmed or suitably configured to prevent loading of any additional waste material 22 into the compaction chamber 214 when the detected weight corresponds to the predetermined value of weight.

Preferably, the controller 262 is further programmed or suitably configured to cause the compaction ram 218 to discharge the waste log 12 through the discharge opening 228, when the total weight of the waste material 22 in the compaction chamber 214 and any portion of the waste log 12 extending out of the compaction chamber 214 reaches the predetermined value of weight.

The controller 262 also can be programmed or suitably configured to provide any of the features described above in connection with FIGS. 1–12. The closure device 216, for example, can be provided as at least part of an automatic density regulator which is controlled (e.g., by controller 262) to provide the waste log 12 with a relatively constant density. The operation of the automatic density regulator can be provided in the same or a different manner as in the exemplary embodiment of FIGS. 1–12.

Using the apparatus 10 or 200 of the preferred embodiments, the present invention facilitates performance of a weight measuring method. The weight measuring method can be performed during a compaction and transfer operation.

The method includes an initial step of retracting the compaction ram 18,218 in a compaction chamber 14,214. Waste material 22 is accommodated in the chamber 14,214 when the ram 18,218 is retracted.

Next, as shown in FIG. 13, the waste material 22 is loaded into the compaction chamber 14,214. An initial weight of the waste material 22 is detected.

The waste material 22 then is compacted to provide a waste log 12. In particular, the compaction can be provided by appropriately advancing the ram 18,218 through the chamber 14,214. The ram 18,218 then is retracted again. After retraction, additional waste material 22 can be loaded into the compaction chamber 14,214. Prior to further compaction, a detection is made of any incremental increases in the weight of the waste material 22 attributable to the additional waste material. A running total is kept of the initial weight and the incremental increases. The running total corresponds to the weight of the waste log 12.

Next, the waste material 22 and the additional waste material are compacted to augment the waste log 12. The discharge opening 28,228 is eventually opened to permit transfer of the waste log 12 out of the compaction chamber 14,214. Preferably, however, the density of the waste log 12 is regulated by selectively restricting and opening the discharge opening 28,228 in a manner dependent upon pressure exerted by the waste log 12 against the closure device 16,216 at the discharge opening 28,228.

In addition, or alternatively, the method further comprises the steps of comparing the running total to the predetermined value of weight corresponding to a maximum weight of the waste log 12, and preventing loading of any additional waste material 22 into the compaction chamber 14,214 when the running total at least reaches the predetermined value of weight.

While this invention has been described as having a preferred design, it is understood that the invention is not limited to the illustrated and described features. To the contrary, the invention is capable of further modifications, usages, and/or adaptations following the general principles of the invention and therefore includes such departures from the present disclosure as come within known or customary practice in the art to which the invention pertains, and as may be applied to the central features set forth above, and which fall within the scope of the appended claims.

We claim:

1. A compaction and transfer apparatus adapted to measure the length of a waste log during compaction and transfer thereof, said apparatus comprising:

a compaction chamber adapted to receive waste material, said compaction chamber having a discharge opening;

a trailer operably associated with said chamber;

a closure device which is selectively movable into and out of the discharge opening to control a size of the discharge opening;

a compaction ram which is movable through the chamber to press said waste material against said closure device and thereby provide compaction of said waste material into a waste log, wherein said compaction ram further moves said waste log from the chamber and onto the trailer; and a movement detector adapted to detect movement of said waste log through said discharge opening, which movement corresponds to the length of the waste log extending out of the discharge opening.

2. The compaction and transfer apparatus of claim 1, further comprising a controller connected to said movement detector, said controller being adapted to compare a detected movement of said waste log, as determined by said movement detector, to a predetermined value of movement associated with a maximum length of the waste log, said controller being further adapted to effect opening of said closure device and discharging of the waste log when said detected movement corresponds to the predetermined value of movement.

3. The compaction and transfer apparatus of claim 2, further comprising a weight detector adapted to detect the weight of said waste material, said controller being further adapted to prevent additional waste material from being loaded into said compaction chamber and to cause said compaction ram to discharge said waste log through said discharge opening, when the total weight of the waste material in said compaction chamber and any portion of the waste log extending out of the compaction chamber reaches a first predetermined weight.

4. The compaction and transfer apparatus of claim 3, wherein said at least one rotatable wheel includes three rotatable wheels.

5. The compaction and transfer apparatus of claim 1, wherein said closure device is at least part of an automatic density regulator which is controlled to provide said waste log with a relatively constant density.

6. The compaction and transfer apparatus of claim 5, wherein said automatic density regulator includes a controller, said controller being adapted to cause said closure device to initially obstruct a majority of said discharge opening until pressure exerted by said waste material against said closure device as a result of compaction by said compaction ram reaches a first predetermined threshold, said controller being further adapted to move said closure device out of said discharge opening until said pressure drops to a second predetermined threshold or until said closure device achieves a predetermined angle with respect to the discharge opening, said second predetermined threshold being lower than said first predetermined threshold, said controller being further adapted to gradually bring said closure device back into said discharge opening until said pressure returns to said first predetermined threshold, and to cause said closure device to repetitively execute said movement out of the discharge opening and movement gradually into the discharge opening as said pressure fluctuates between said first and second predetermined thresholds or between said first predetermined threshold and a pressure achieved when said closure device achieves said predetermined angle with respect to the discharge opening, whereby said waste log is discharged with a relatively constant density; and wherein said controller is connected to said movement detector, said controller being adapted to compare a detected movement of said waste log, as determined by said movement detector, to a predetermined value of movement associated with a maximum length of the waste log, said controller being further adapted to effect opening of said closure device and discharging of said waste log when said detected movement corresponds to the predetermined value of movement.

7. The compaction and transfer apparatus of claim 6, wherein said movement detector includes:

at least one rotatable wheel mounted on said closure device, said at least one rotatable wheel having a circumferential portion which projects at least partially out from said at least one closure device to engage said waste log, whereby movement of said waste log causes said at least one rotatable wheel to rotate; and a conversion device adapted to convert mechanical rotation of said at least one rotatable wheel into a signal indicative of such mechanical rotation, said controller being adapted to determine said length of the waste log based on said signal indicative of mechanical rotation.

8. The compaction and transfer apparatus of claim 1, wherein said movement detector includes:

at least one rotatable wheel mounted on said closure device, said at least one rotatable wheel having a circumferential portion which projects at least partially out from said at least one closure device to engage said waste log, whereby movement of said waste log causes said at least one rotatable wheel to rotate; and a conversion device adapted to convert mechanical rotation of said at least one rotatable wheel into a signal indicative of such mechanical rotation.

9. The compaction and transfer apparatus of claim 1, further comprising a weight detector adapted to detect the weight of said waste material.

10. The compaction and transfer apparatus of claim 1, wherein said movement detector is mounted to said closure device.

11. A method of measuring the length of a waste log during a compaction and transfer operation, said method comprising the steps of:

providing a compaction chamber to accommodate waste material;

loading waste material into the compaction chamber;

compacting the waste material to form said waste log;

positioning a trailer adjacent the chamber;

opening a discharge opening of the compaction chamber, at least partially, to permit transfer of said waste log out of said compaction chamber and onto the trailer; and detecting movement of said waste log through said discharge opening, said movement corresponding to the length of said waste log extending out of said compaction chamber.

12. The method of claim 11, further comprising the step of regulating a density of said waste log by selectively restricting and opening said discharge opening in a manner dependent upon pressure exerted by said waste log against a closure device at said discharge opening.

13. The method of claim 12, further comprising the steps of:

comparing a detected amount of movement, as detected during said detecting step, to a predetermined amount of movement corresponding to a maximum length of said waste log; and opening said discharge opening and discharging said waste log when said detected amount of movement equals said predetermined amount of movement, to prevent said waste log from exceeding said maximum length.

14. The method of claim 13, further comprising the step of:

detecting a weight of said waste material; and terminating said step of loading when said weight reaches a predetermined weight threshold.

15. The method of claim 11, further comprising the steps of:

comparing a detected amount of movement, as detected during said detecting step, to a predetermined amount of movement corresponding to a maximum length of said waste log; and opening said discharge opening and discharging said waste log when said detected amount of movement equals said predetermined amount of movement, to prevent said waste log from exceeding said maximum length.

16. The method of claim 11, further comprising the step of:

detecting a weight of said waste material; and terminating said step of loading when said weight reaches a predetermined weight threshold.

* * * * *